US008280090B2

(12) United States Patent
Parsi

(10) Patent No.: US 8,280,090 B2
(45) Date of Patent: Oct. 2, 2012

(54) MOLDED PULL STRING FOR CUSTOM HEARING INSTRUMENTS

(75) Inventor: Salman Parsi, Somerset, NJ (US)

(73) Assignee: Siemens Medical Instruments Pte. Ltd., Singapore (SG)

( * ) Notice: Subject to any disclaimer, the term of this patent is extended or adjusted under 35 U.S.C. 154(b) by 851 days.

(21) Appl. No.: 12/210,353

(22) Filed: Sep. 15, 2008

(65) Prior Publication Data

US 2010/0067724 A1 Mar. 18, 2010

(51) Int. Cl.
*H01R 25/00* (2006.01)

(52) U.S. Cl. ..... 381/329; 381/328; 381/322

(58) Field of Classification Search ..... 381/312, 381/322, 324, 328, 329, FOR. 127, FOR. 133, 381/FOR. 135, FOR. 138, FOR. 151
See application file for complete search history.

(56) References Cited

U.S. PATENT DOCUMENTS

| | | | | |
|---|---|---|---|---|
| 5,381,484 | A * | 1/1995 | Claes et al. | 381/329 |
| 6,529,609 | B1 * | 3/2003 | Neilson et al. | 381/329 |
| 7,010,137 | B1 | 3/2006 | Leedom et al. | |
| 7,256,747 | B2 * | 8/2007 | Victorian et al. | 343/718 |
| 2002/0196954 | A1 * | 12/2002 | Marxen et al. | 381/312 |

* cited by examiner

*Primary Examiner* — Matthew E Warren
(74) *Attorney, Agent, or Firm* — Francis G Montgomery

(57) ABSTRACT

A pull string for a hearing instrument may be attached to an anchor positioned on the inside wall of the hearing instrument shell. Collision detection may be utilized to determine a location for the anchor and the pull string.

5 Claims, 7 Drawing Sheets

MOLDED PULL STRING FOR CUSTOM HEARING INSTRUMENTS

CROSS-REFERENCE TO RELATED APPLICATIONS

This application is related to U.S. Patent Application Publication No. 2002/0196954 A1, published Dec. 26, 2002, and titled "Modeling and fabrication of three-dimensional irregular surfaces for hearing instruments," incorporated herein by reference.

BACKGROUND AND SUMMARY OF THE INVENTION

Currently, pull strings for hearing instruments are made from clear fishing line. A knot is formed at one end of the string or the end is melted back using a soldering iron, to create a mechanical support. This end is then glued to the inside of the hearing instrument shell or to the faceplate.

There are at least two disadvantages to this approach—uncertainty in finding a suitable location for the pull string within the shell and, oftentimes, a less-than optimal utilization of the space within the shell. The foregoing disadvantages can be avoided by locating the pull string within the shell of the hearing instrument using collision detection techniques. Once this location has been determined, an anchor is created on the inside surface of the hearing instrument shell. The pull string is fabricated as a molded element with a fixed end that cooperatively engages the anchor, and its free end is routed through an opening in the faceplate of the hearing instrument.

DESCRIPTION OF THE INVENTION

Figure 1:
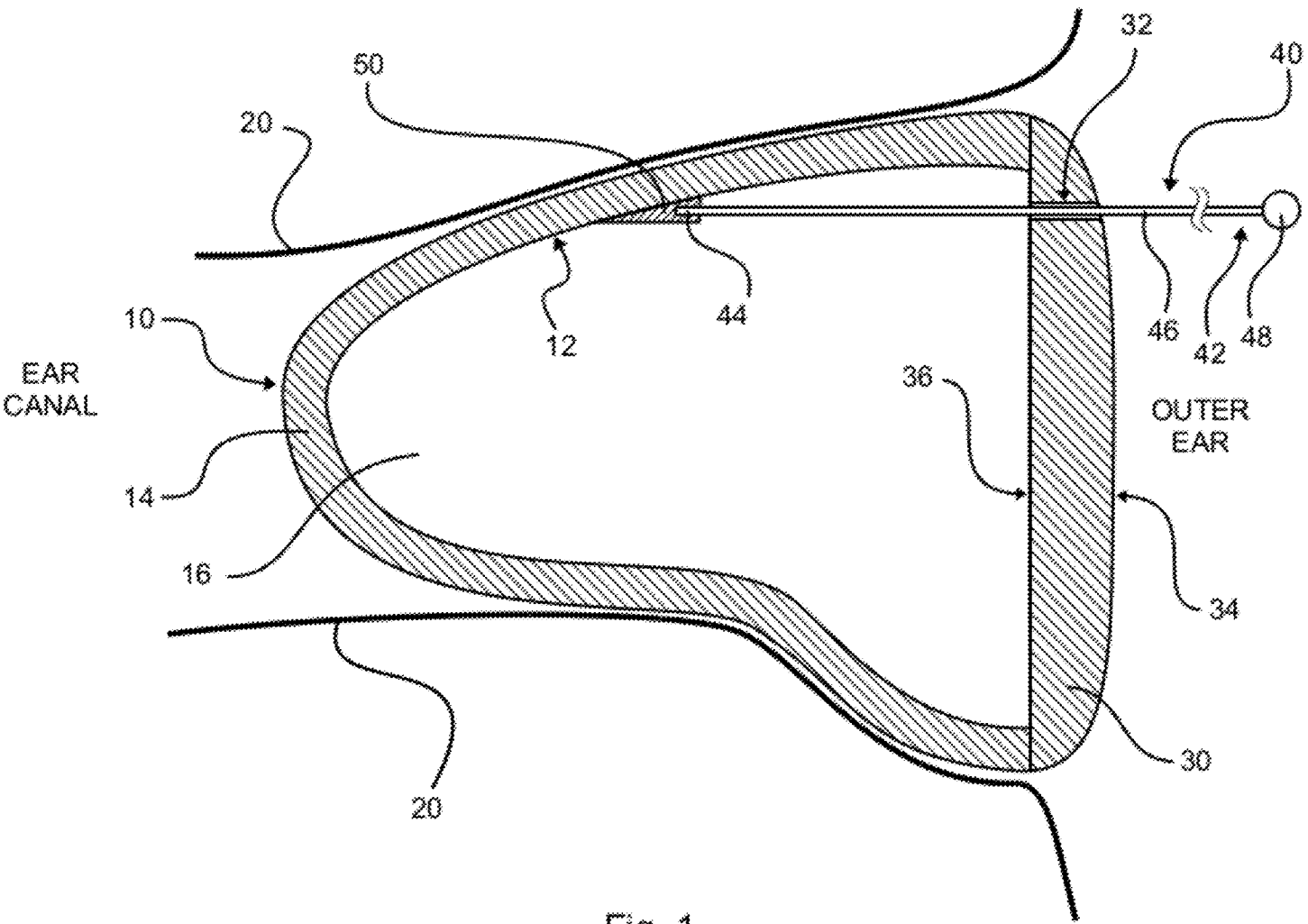
FIG. 1 is a cross-sectional drawing of a hearing instrument shell residing in the ear canal, with a pull string affixed to an anchor inside the shell.

A hearing instrument shell assembly, comprising a shell 10, is shown in FIG. 1 residing in an ear canal, defined by ear canal walls 20, between the eardrum and the outer ear. The shell 10 comprises an inside shell wall surface 12 and a shell wall 14. The shell assembly further comprises a faceplate 30 attached to the shell 10 at the point closest to the outer ear. Together, the shell 10 and the faceplate 30 enclose and define a hearing instrument shell interior 16. The faceplate 30 has an outer surface 34 facing the outer ear and an inner surface 36, generally parallel to the outer surface 34, facing the shell interior 16.

A molded pull string 40 is provided to aid in removal of the shell 10 from the ear canal. The pull string 40 has a free end 42 located outside the outer surface 34 of the faceplate (i.e., exterior to the shell assembly and towards the outer ear) and a fixed end 44 attached to an anchor 50 (depicted here schematically) on the inside shell wall surface 12 of the shell 10. The shaft 46 of the pull string 40 passes through a passage 32 in the faceplate 30 connecting the outer and inner surfaces 34 and 36.

Anchor Configurations

The anchor 50 may assume a number of configurations. For example, in FIG. 2, the anchor is a post 60 and the fixed end 44 of the pull string 40 is an annulus 70 that slips onto the post 60. The post 60 is shown again in the elevation view of FIG. 3, where the annulus 70 is illustrated in partial cross-section. The post 60 may be circular in cross section or have some other shape as desired—square, triangular, etc. If the post 60 has a non-circular cross section, the pull string 40 may be provided with a conforming opening in the fixed end 44.

Figure 2:
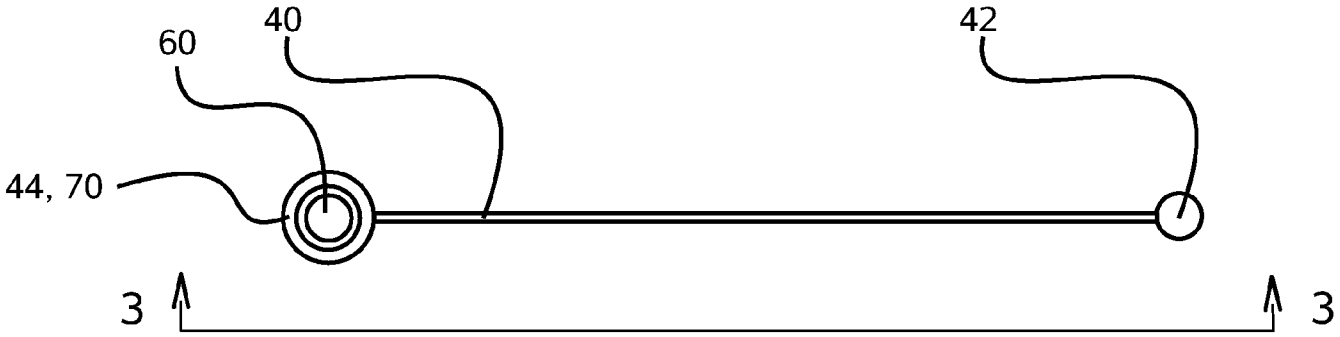
FIGS. 2-14 are drawings of various configurations of the pull string and the anchor of FIG. 1.
Figure 3:
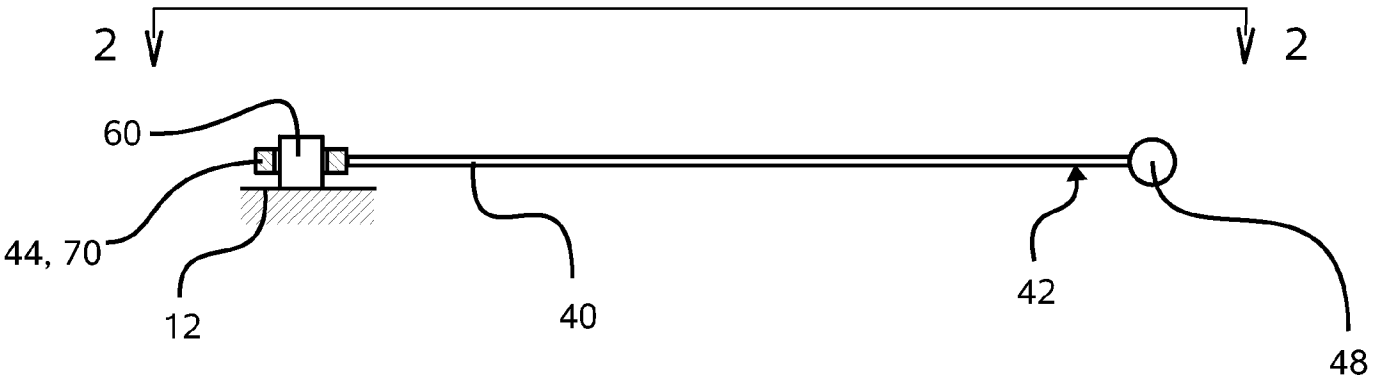
Figure 4:
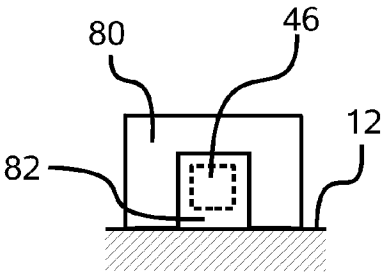
Figure 7:
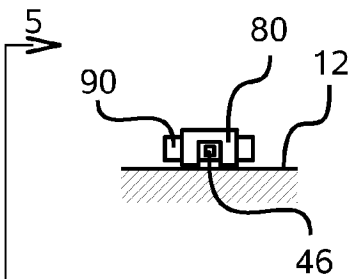
Figure 5:
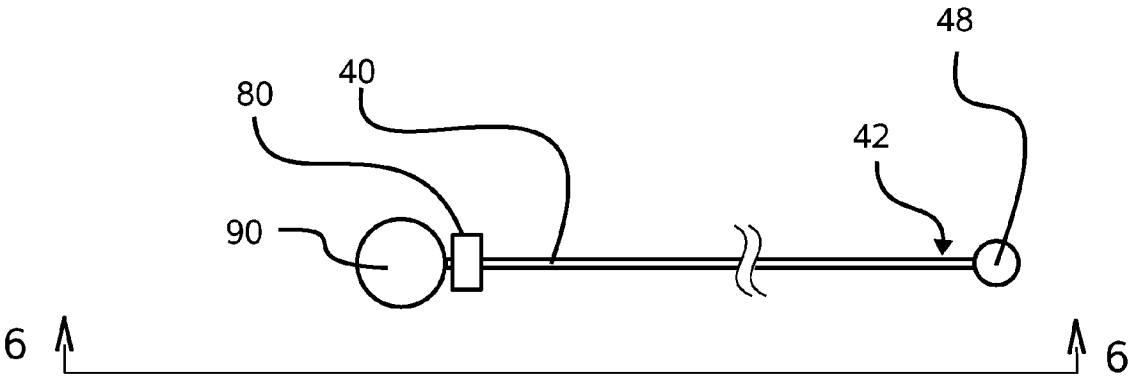
Figure 6:
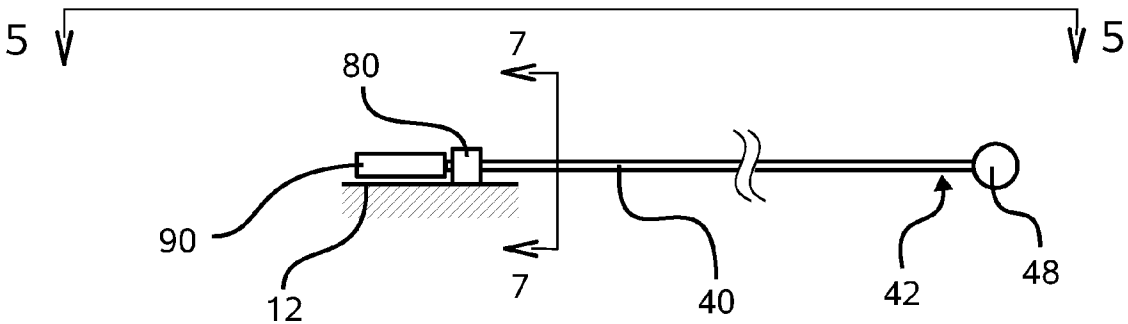
Figure 8:
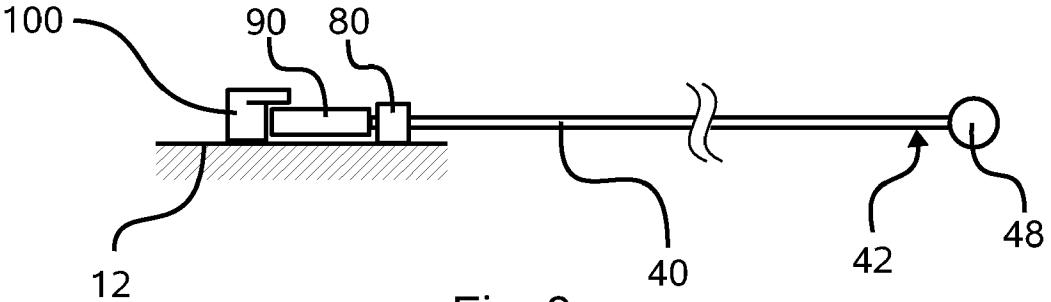
Figure 9:
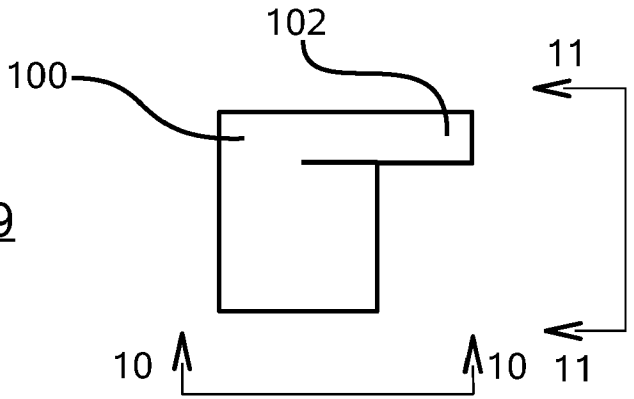
Figure 10:
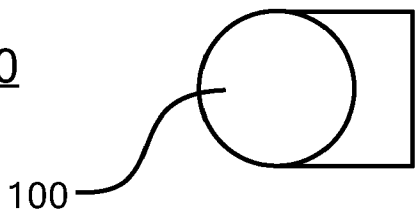
Figure 11:
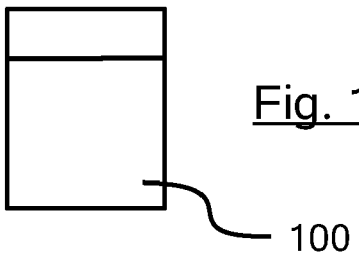

Instead of the post 60 and annulus 70 of FIGS. 2 and 3, the pull string 40 may be secured to the inside shell wall surface 12 by placing a restraining arch 80 (FIG. 4) over the shaft 46 of the pull string 44 (shown in phantom). The fixed end 44 of the pull string 40 may be configured as a disk 90 or some other shape and size such that it cannot pass through the opening 82 in the arch 80. In lieu of a disk 90, the fixed end 44 of the pull string 40 may be fashioned as a sphere, a polyhedron, a half-disk, or any other suitable shape. The arch 80, together with the pull string 40, is shown in the top, elevation, and partial cross-sectional views of FIGS. 5-7, respectively.

To further secure the fixed end 44 of the pull string 40, a tab and post assembly 100 may be positioned on the inside shell wall surface 12 behind the arch 80, as shown in FIGS. 8-11. The tab and post assembly 100 has a tab 102 that lays over the disk 90.

Figure 12:
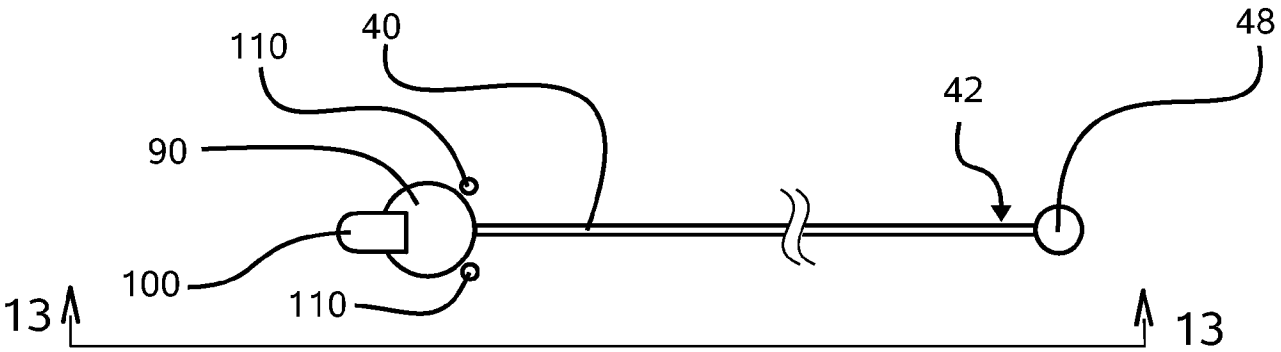
Figure 13:
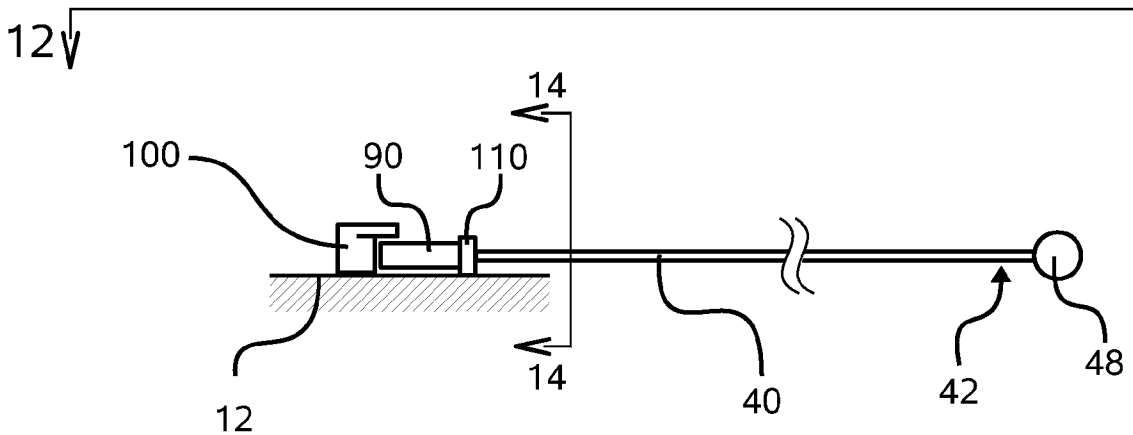
Figure 14:
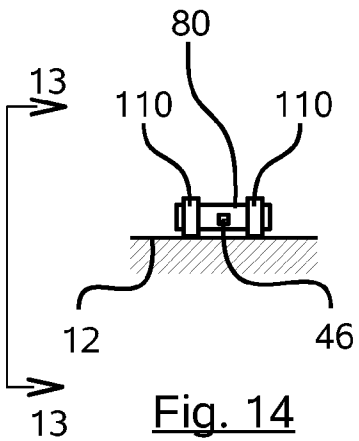

Two posts 110 may be substituted for the arch 80 as illustrated in FIGS. 12-14. The posts 110 may be fashioned as cylinders (as shown in the figures), or may utilize another cross section as desired.

Partially Embedding the Pull String and the Anchor

Figure 15:
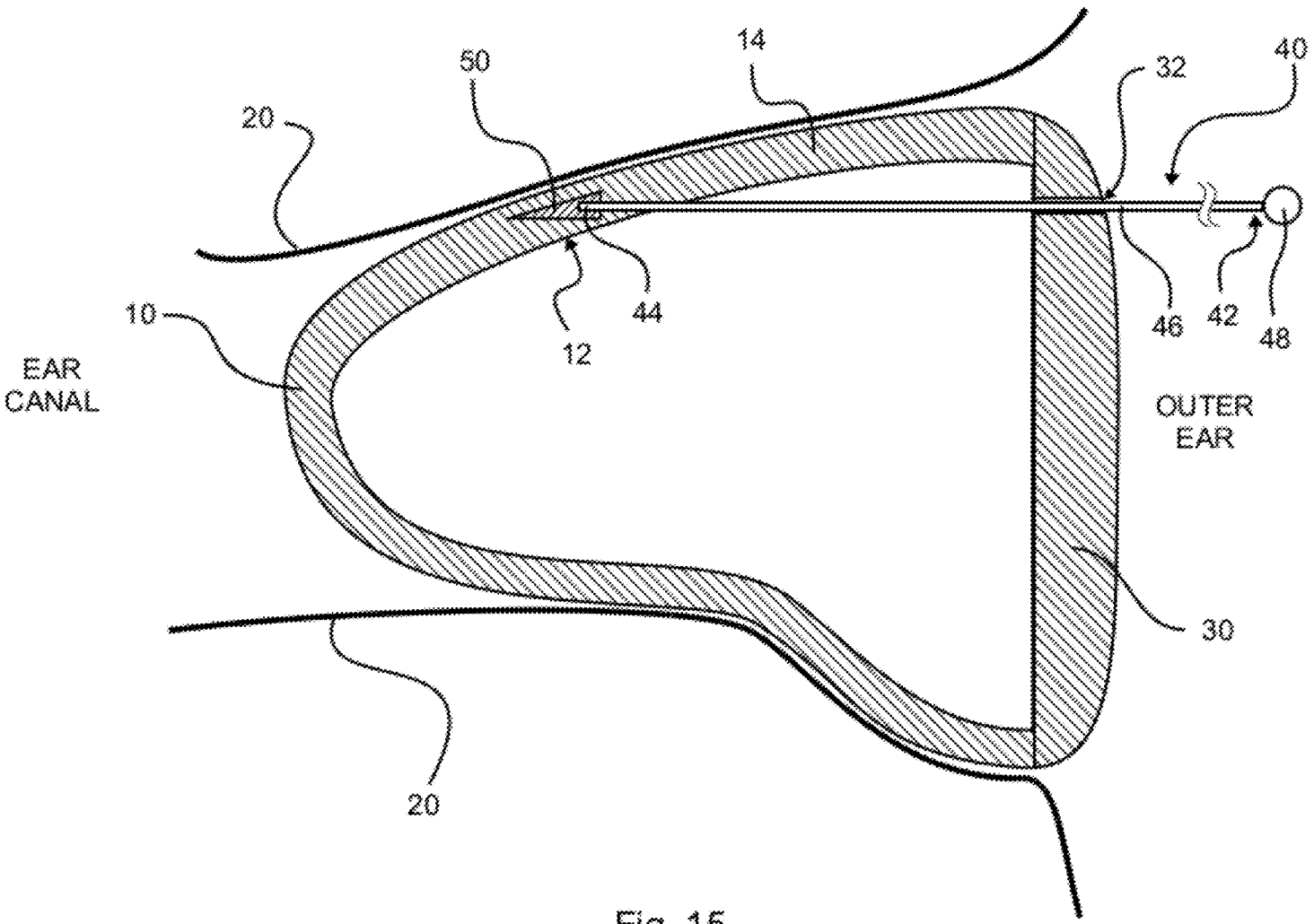
FIG. 15 is a cross-sectional drawing of a hearing instrument shell residing in the ear canal, with a pull string affixed to an anchor inside the shell, where the anchor and the pull string are embedded within the wall of the shell.

To further conserve the use of space within the shell and provide structural support for the pull string 40, a portion of the pull string shaft 46 may be embedded within the wall 14 of the shell 10, as shown in FIG. 15. Similarly, the anchor 50 may be fully or partially embedded within the shell wall 14.

Materials

The pull string 40 may be fashioned from a material such as Vydyne 215PF natural nylon in an injection molding process. The material selected should be capable of withstanding a pull force of 15-20 Newtons.

Shell Design and Component Placement

Figure 16:
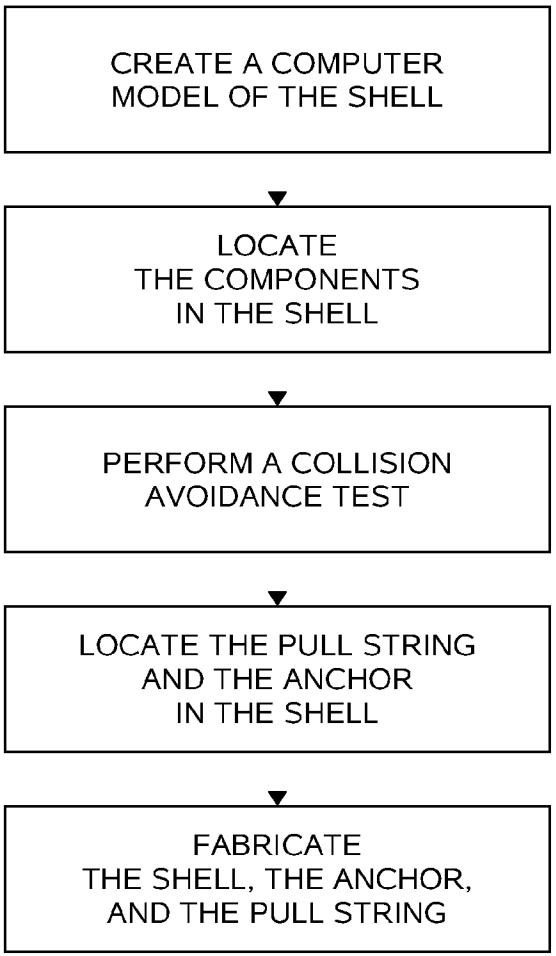
FIG. 16 is a flow chart of a process for locating the pull string and the anchor within the shell.

The location of the anchor 50 and the pull string 40 inside the shell 10 may be selected using collision detection methods to avoid conflicts with other components within the shell 10, as indicated in the flow chart of FIG. 16. Initially, a computer model of the hearing instrument shell 10 is created. The components of the hearing instrument are then positioned within the shell model and a collision avoidance test is performed. A location within the shell 10 for the pull string 40 and the anchor 50 can then be chosen. The shell 10, the anchor 50, and the pull string 40 can then be fabricated.

The foregoing process may be used to design the hearing instrument shell 10 of FIG. 15, with the understanding that a portion of the pull string shaft 46 and possibly all or part of the anchor 50 would be embedded within the wall 14 of the shell 10.

Assembly

Figure 17:
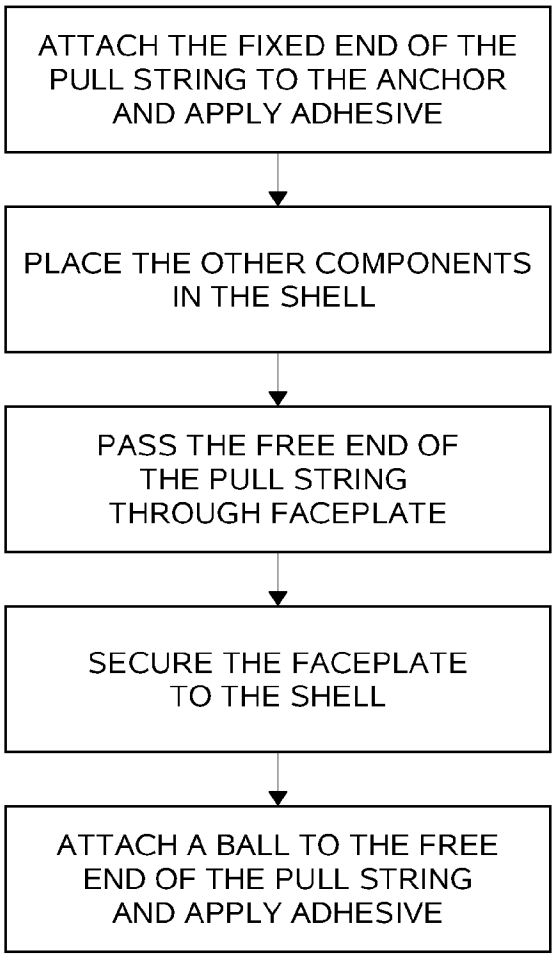
FIG. 17 is a flow chart of a process for attaching the pull string to the hearing instrument shell.

During assembly, the fixed end 44 of the pull string 40 is attached to the anchor 50, as indicated in the flow chart of FIG. 17. The fixed end 44 may be further secured to the anchor 50 by an adhesive such as a clear paste cured with ultraviolet light.

The free end 42 of the pull string 40 may then be routed through the passage 32 in the faceplate 30, and its length trimmed as desired. To enable the user to securely grasp the free end 42 of the pull string 40, a ball 48 or any other suitable structure may be attached to the free end 42 and secured with an adhesive.

What is claimed is:

1. A hearing instrument shell assembly for a hearing instrument residing in an ear canal between the eardrum and the outer ear, comprising:

a hearing instrument shell comprising a shell wall and an inside shell wall surface;

a faceplate attached to the shell, the faceplate and the shell enclosing a hearing instrument shell interior, where the faceplate comprises an outer surface facing the outer ear;

an inner surface facing the shell interior, where the inner surface is generally parallel to the outer surface; and a passage through the faceplate connecting the inner and outer surfaces;

an anchor affixed to the inside shell wall surface of the hearing instrument shell; and a pull string comprising a shaft, and fixed and free ends, where the shaft passes through the passage in the faceplate;

the fixed end of the pull string is affixed to the anchor; and the free end is positioned outside the outer surface of the faceplate.

2. An assembly as set forth in claim 1, where the fixed end comprises an annulus; and the anchor comprises a post.

3. An assembly as set forth in claim 1, where the anchor comprises a restraining arch through which the pull string shaft passes.

4. An assembly as set forth in claim 1, where the anchor comprises vertical posts through which the pull string shaft passes.

5. A hearing instrument shell assembly for a hearing instrument residing in an ear canal between the eardrum and the outer ear, comprising:

a hearing instrument shell comprising a shell wall and an inside shell wall surface;

a faceplate attached to the shell, the faceplate and the shell enclosing a hearing instrument shell interior, where the faceplate comprises an outer surface facing the outer ear;

an inner surface facing the shell interior, where the inner surface is generally parallel to the outer surface; and a passage through the faceplate connecting the inner and outer surfaces;

an anchor at least partially embedded within the shell wall of the hearing instrument shell; and a pull string comprising a shaft, and fixed and free ends, where the shaft passes through the passage in the faceplate;

the fixed end of the pull string is affixed to the anchor, where a portion of the shaft is embedded within the shell wall; and the free end is positioned outside the outer surface of the faceplate.

* * * * *